US005951849A

United States Patent [19]

Miller et al.

[11] Patent Number: 5,951,849

[45] Date of Patent: Sep. 14, 1999

[54] RESID HYDROPROCESSING METHOD UTILIZING A METAL-IMPREGNATED, CARBONACEOUS PARTICLE CATALYST

[75] Inventors: Jeffrey T. Miller, Naperville; Ronald B. Fisher, Geneva; Tracy L. Marshbanks, Boling Brook, all of Ill.

[73] Assignee: BP Amoco Corporation, Chicago, Ill.

[21] Appl. No.: 08/761,746

[22] Filed: Dec. 5, 1996

[51] Int. Cl.[6] ..... C10G 47/06

[52] U.S. Cl. ..... 208/112; 208/108; 502/180; 502/182; 502/185

[58] Field of Search ..... 208/108, 112; 502/180, 182, 185

[56] References Cited

U.S. PATENT DOCUMENTS

| | | | |
|---|---|---|---|
| 4,134,825 | 1/1979 | Bearden, Jr. et al. | 208/108 |
| 4,176,051 | 11/1979 | Ternan et al. | 208/112 |
| 4,178,227 | 12/1979 | Mctrailer et al. | 208/50 |
| 4,214,977 | 7/1980 | Ranganathan et al. | 208/108 |
| 4,295,995 | 10/1981 | Bearden, Jr. et al. | 252/431 |
| 4,295,996 | 10/1981 | Bearden, Jr. et al. | 252/431 |
| 4,299,685 | 11/1981 | Khulbe et al. | 208/48 |
| 4,357,229 | 11/1982 | Bearden, Jr. et al. | 208/10 |
| 4,376,037 | 3/1983 | Dahlberg et al. | 208/111 |
| 4,389,301 | 6/1983 | Dahlberg et al. | 208/99 |
| 4,406,772 | 9/1983 | Sasaki et al. | 208/112 |
| 4,431,520 | 2/1984 | Giuliani et al. | 208/112 |
| 4,495,306 | 1/1985 | Budahn et al. | 502/185 |
| 4,557,822 | 12/1985 | Bearden, Jr. et al. | 208/112 |
| 4,557,823 | 12/1985 | Kukes et al. | 208/216 |
| 4,564,441 | 1/1986 | Kukes et al. | 208/108 |
| 4,578,179 | 3/1986 | Kukes et al. | 208/110 |
| 4,579,646 | 4/1986 | Grosboll et al. | 208/108 |
| 4,770,764 | 9/1988 | Ohtake et al. | 208/73 |
| 4,806,227 | 2/1989 | Beale, Jr. et al. | 208/22 |
| 4,831,003 | 5/1989 | Lang et al. | 502/182 |
| 4,863,887 | 9/1989 | Ohtake et al. | 502/150 |
| 4,940,529 | 7/1990 | Beaton et al. | 208/61 |
| 4,969,988 | 11/1990 | Jain et al. | 208/108 |
| 5,013,427 | 5/1991 | Mosby et al. | 208/211 |
| 5,051,389 | 9/1991 | Lang et al. | 502/185 |
| 5,055,174 | 10/1991 | Howell et al. | 208/112 |
| 5,124,025 | 6/1992 | Kolstad et al. | 208/309 |
| 5,124,026 | 6/1992 | Taylor et al. | 208/309 |
| 5,124,027 | 6/1992 | Beaton et al. | 208/309 |
| 5,288,681 | 2/1994 | Gatsis | 502/152 |
| 5,320,741 | 6/1994 | Johnson et al. | 208/49 |
| 5,412,130 | 5/1995 | Karol | 556/57 |
| 5,446,002 | 8/1995 | Kukes et al. | 502/155 |
| 5,489,375 | 2/1996 | Joseph et al. | 208/108 |

FOREIGN PATENT DOCUMENTS

| | | | |
|---|---|---|---|
| 1207265 | 7/1986 | Canada | C10G 45/00 |
| 0 271 337 | 6/1988 | European Pat. Off. . | |
| 0429132 | 11/1990 | European Pat. Off. | C10G 49/02 |
| 4122790 | 4/1992 | Japan | C10G 47/36 |

OTHER PUBLICATIONS

Excerpt from Kirk–Othmer Encyclopedia of Chemical Technology 4th Edition entitled "Carbon Black" published by John Wiley & Sons, Inc. pp. 1037–1074, 1992 (No Month Available).

*Primary Examiner*—Walter D. Griffin
*Attorney, Agent, or Firm*—Robert A. Yesukevich; Richard A. Kretchmer; Frank J. Sroka

[57] ABSTRACT

A method for converting a hydrocarbonaceous feedstock to a lower boiling product is described which comprises suspending metal-impregnated carbonaceous particles in a reaction zone including hydrogen and the hydrocarbonaceous feedstock at hydrocracking conditions. The metal impregnated on the particles may be sulfided in the reaction zone. The impregnated particles are shown to be surprisingly selective catalysts, and anomalous ranges of particle size and concentration are identified. Methods for preparing the particles are additionally presented.

17 Claims, 3 Drawing Sheets

■ CATALYST OF THE INVENTION:
MOLYBDENUM IMPREGNATED ON CARBON PARTICLES
× UNIMPREGNATED MOLYBDENUM WITH CARBON PARTICLES
□ MOLYBDENUM WITHOUT CARBON PARTICLES

RESID HYDROPROCESSING METHOD UTILIZING A METAL-IMPREGNATED, CARBONACEOUS PARTICLE CATALYST

BACKGROUND OF THE INVENTION

1. Field of the Invention

The present invention relates to catalysts and processes for treating heavy feedstocks such as petroleum residuum. The invention more particularly relates to catalysts suitable for promoting hydrocracking reactions which convert such feedstocks to products having relatively lower boiling temperatures, to processes for making and using the catalysts, and to processes for using such catalysts.

2. Description of the Prior Art

Maximizing the yield of highly-valued products from crude oil often results in the production of relatively heavy hydrocarbon streams which are difficult to up-grade to lighter products. Typically, these streams are distillation bottoms resulting from the atmospheric or vacuum distillation of a crude oil or a crude oil-derived feedstream. These bottoms fractions are known as petroleum residuum or "resid." Resids typically contain only a small amount of material boiling below about 1000° F. at atmospheric pressure, up to several tens of percent of Ramsbottom carbon, and up to several hundred parts per million of metals such as nickel and vanadium.

Modern refinery economics demand that resids be processed to yield lighter and more valuable hydrocarbons. Typically, resid will be upgraded in a multi-reactor, supported catalyst system such as those described in U.S. Pat. Nos. 4,940,529 issued to Beaton et al; 5,013,427 issued to Mosby et al.; 5,124,025 issued to Kolstad et al.; 5,124,026 issued to Taylor et al.; and 5,124,027 issued to Beaton et al., all assigned to the assignee of the present invention, the disclosures of which are hereby incorporated by reference. While supported catalyst systems such as those disclosed in the foregoing patents have proven highly effective in upgrading heavy feedstreams such as resids, refiners continue to investigate other processes for obtaining valuable products from resids.

Another approach for upgrading resid is to hydrocrack resid in the presence of a soluble catalyst which is eventually precipitated to produce a solid catalyst dispersed as, for example, a suspended bed or an ebullating bed. This approach is described, among other places, in U.S. Pat. No. 5,055,174 issued to Howell et al.; U.S. Pat. No. 5,446,002 issued to Kukes et al.; and U.S. Pat. No. 5,489,375 issued to Joseph et al., which are hereby incorporated by reference. Although the soluble catalyst is at least initially soluble in a feedstock or a carrier liquid, the soluble catalyst is generally precipitated to provide a dispersion of fine solids, such as metal disulfide particles, in the reactor.

Other researchers have reported that the presence of additional particulate matter tends to suppress coke production within a resid hydrocracking reaction zone that includes a fine catalytic dispersion of the type which may be precipitated from a soluble catalyst. U.S. Pat. No. 4,178,227 issued to Metrailer et al.; U.S. Pat. No. 4,376,037 issued to Dahlberg et al.; U.S. Pat. Nos. 4,770,764 and 4,863,887 issued to Ohtake et al.; and U.S. Pat. No. 5,320,741 issued to Johnson et al., which are hereby incorporated by reference, describe catalyst systems which contain fine contact particles and a dispersed precipitate from a soluble catalyst. U.S. Pat. No. 4,406,772 issued to Sasaki et al. describes a hydroconversion process which converts heavy hydrocarbon oils such as vacuum residua into light hydrocarbon oils, employing a catalyst which is obtained as a byproduct of the process. The catalyst includes coke produced by the hydrotreatment and a metal belonging to Groups VB or Group VIII of the Periodic Table, such as iron, vanadium, or nickel, which is derived from the heavy hydrocarbon oils and deposited on the coke during the hydrotreatment.

Canadian Patent No. 1,207,265 listing Graeser et al. as inventors describes a method for hydrogenating heavy oil in the presence of a catalyst which is the soot obtained from gasification or partial combustion of heavy oil or solid fuel. The soot is reportedly actuated by treatment with carbon monoxide, carbon dioxide, or water at high temperatures in order to obtain a relatively great internal surface area which is said to facilitate adsorptive binding of the soot to coke particles. The Graeser et al. patent also reports that the activity of the catalyst can be increased by impregnating the soot with a salt of one or more catalytically active metals, especially titanium, chromium, iron, cobalt, nickel, tin, or lead.

Open Japanese Patent Application No. 4-122790 listing Matsui as inventor appears to describe a process for catalytically hydrogenating heavy oil which contains polycyclic aromatics, such phenanthrene, to produce monocyclic or bicyclic aromatics. The Matsui application states that the source material can be produced from coal tar, oil sand tar, petroleum heavy oil or biomass tar. Reportedly, the active ingredient of the catalyst is cobalt, molybdenum, nickel, or tungsten. The metal is apparently sulfided before use. The Matsui application also states that a porous material such as alumina, silica-alumina, silica, or carbon black can be employed as a carrier for the active ingredient.

To facilitate the cost-efficient upgrading of hydrocarbon feedstocks such as resid, new catalysts and processes are required which minimize catalyst preparation costs and maximize the effectiveness of soluble catalysts under the aggressive operating conditions typically required to produce substantial quantities of lighter, more valuable products from a heavy hydrocarbon feedstock such as resid.

SUMMARY OF THE INVENTION

The invention provides a method for converting hydrocarbonaceous feedstock to lighter products through contact with hydrogen and a dispersion of minute particles which are composed substantially of a relatively dense, non-porous material and which physically support a catalytically active transition metal compound. The particles can be prepared by impregnating a sulfidable water-soluble metal compound on a relatively dense, non-porous material having a particle size of about fifty microns or less and sulfiding the metal compound. The particles of the present invention offer a greater conversion activity and a lesser coking rate, as compared to the activity and coking rate associated with particles consisting of the sulfided metal compound and relatively dense, non-porous carbon particles of corresponding size which have not been impregnated. Impregnating larger particles with the metal compound does not give rise to the advantages provided by the present invention.

In one aspect, the invention is a method for converting a hydrocarbonaceous feedstock. The method comprises suspending metal-impregnated carbonaceous particles which have an effective suspended particle size of about 0.01 to about 50 microns, and which physically support a sulfide of a water-soluble metal compound including a sulfidable metal selected from the group consisting of molybdenum, cobalt, nickel, iron, vanadium, tungsten and mixtures thereof, in a reaction zone which includes hydrogen and a hydrocarbonaceous feedstock so as to create a dispersion. Conditions are maintained in the reaction zone which are effective to convert the feedstock to a product having a boiling point of lower temperature, as compared to the boiling point of the feedstock, and the lower boiling point product is recovered. It is preferred that the metal-impregnated particles are substantially composed of oxidized carbon black.

In another aspect, the invention is a method for converting a hydrocarbonaceous feedstock substantially similar to the method described above, but additionally comprising sulfiding carbonaceous catalyst precursor particles which include a water-soluble metal compound containing a sulfidable metal selected from the group consisting of molybdenum, cobalt, nickel, iron, vanadium, tungsten and mixtures thereof to produce catalyst particles substantially composed of carbon and a sulfide of the water-soluble metal compound. The catalyst particles are suspended in a reaction zone which includes hydrogen and a hydrocarbonaceous feedstock at effective conditions for hydrocracking, and a lower boiling point product is recovered.

In still another aspect, the invention is a method for preparing catalyst precursor particles which comprises blending carbonaceous particles having a particle size of about 0.01 to about 50 microns with an impregnation solution including an oxygen-containing polar solvent and a water-soluble metal compound containing about 100 to about 50,000 parts per million by weight, based on the total weight of the carbonaceous particles, of a sulfidable metal selected from the group consisting of molybdenum, cobalt, nickel, iron, vanadium, tungsten and mixtures thereof, to produce a blend. A substantial amount of the solvent is vaporized from the blend to produce metal-impregnated catalyst precursor particles. It is preferred that the carbonaceous particles are essentially composed of carbon black which has been sufficiently oxidized so as to be wetted by contact with water.

In yet another aspect, the invention is a method for preparing catalyst particles, which comprises impregnating a water-soluble metal compound containing a sulfidable metal selected from the group consisting of molybdenum, cobalt, nickel, iron, vanadium, tungsten and mixtures thereof on carbonaceous particles having a weight average particle size of about 0.01 to about 50 microns, by blending the particles with an impregnation solution including an oxygen-containing polar solvent and the metal compound to produce a blend and vaporizing a substantial amount of the solvent from the blend, to produce catalyst precursor particles. The impregnated precursor particles are introduced to a liquid-phase hydrocarbon, comminuted to an effective suspended particle size of about 0.01 to about 50 microns, and sulfided to produce catalyst particles. Carbonaceous particles which are essentially composed of oxidized carbon black are preferred.

DETAILED DESCRIPTION OF PREFERRED ASPECTS OF THE INVENTION

Figure 1:
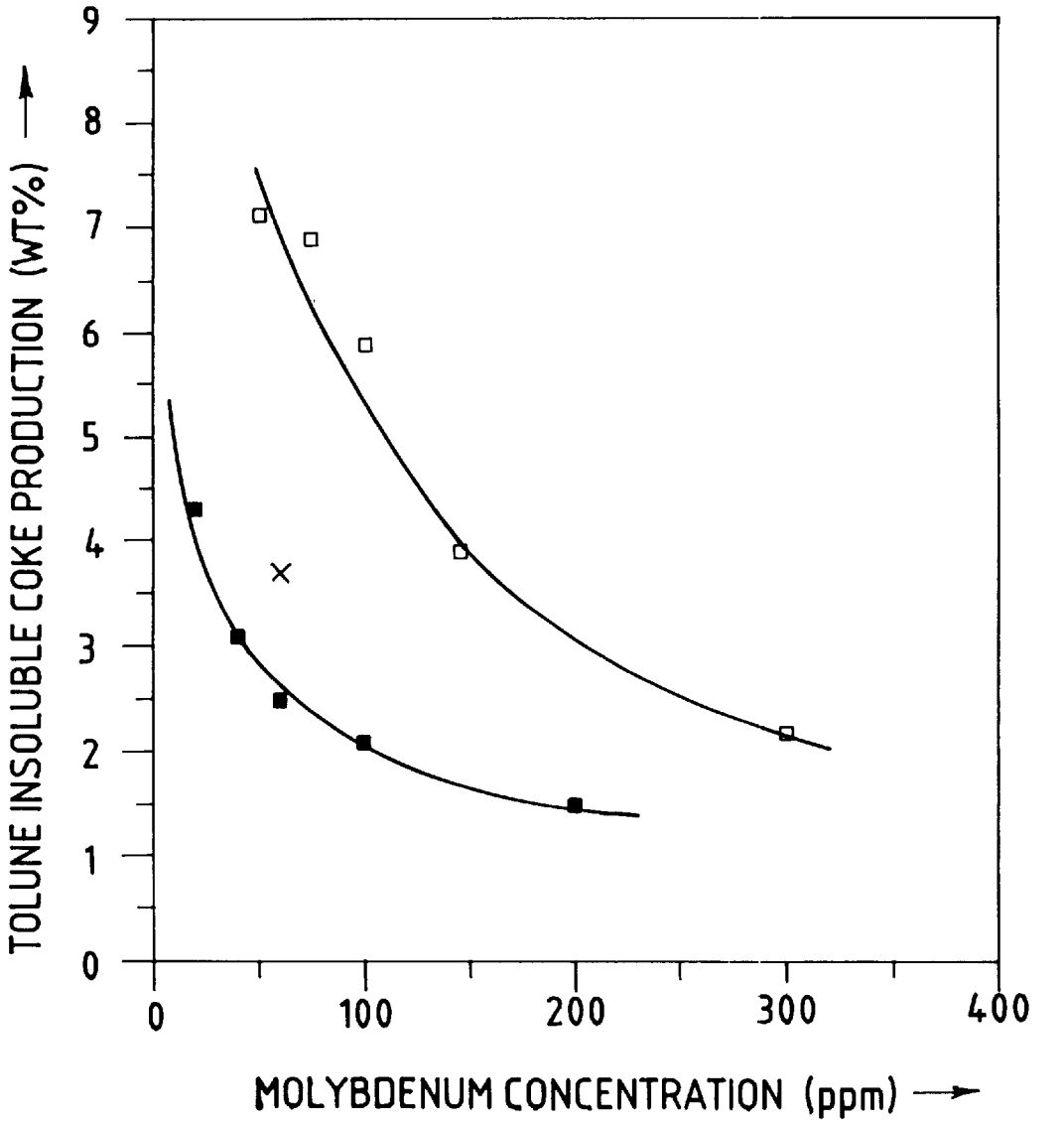
FIG. 1 is a graph which depicts toluene-insoluble coke production as a function of molybdenum concentration for catalysts of the invention and, also, for comparable catalysts which lack impregnation or carbon particles.

In a preferred aspect, the invention is a method for converting hydrocarbonaceous feedstock to a product having a boiling point of lower temperature, as compared to the boiling point of the feedstock. The feedstock may be, for example, petroleum crude oil, shale oil, tar sand oil, a coal-derived liquid, atmospheric or vacuum distillation resid, hydroprocessing or catalytic cracking resid, or the product of solvent extracting a petroleum or a petroleum derivative.

Preferably, the feedstock contains a significant proportion of a boiling range fraction having a weight average boiling point at atmospheric pressure which is equal to or greater than 1000° F. as measured by American Society for Testing and Materials procedure ASTM D-86. Alternatively, because some feedstocks or boiling range fractions thermally decompose at temperatures cooler than their atmospheric points, it is contemplated that the atmospheric boiling temperature may be determined by tests conducted at conditions other than atmospheric. For example, the atmospheric boiling temperature may be inferred from vacuum distillation data employing American Society for Testing and Materials procedure ASTM D-116, or by a chromatographic technique generally known to the petroleum refining industry as simulated distillation.

The method includes suspending metal-impregnated carbonaceous particles in a reaction zone which includes hydrogen and the feedstock so as to create a dispersion. The particles are termed carbonaceous because they are substantially composed of carbon, preferably in the form of carbon black. Carbon black is manufactured by thermal decomposition and partial combustion of hydrocarbons in the vapor phase. Unlike soot, carbon black is essentially free of inorganic contaminants and extractable organic residues. Examples of carbon blacks which are suitable for use in the invention are oil-furnace black, lampblack, thermal black, and acetylene black.

More preferably, the carbonaceous particles are essentially composed of carbon black which has been oxidized as, for example, by contact with nitric acid, ozone, air or other oxidizing agents. Most preferably, the carbon black has been oxidized to the extent that it contains about 2 to about 6 percent by weight oxygen. This level of surface oxidation results in a weight loss of about 2 to about 9.5 percent associated with gas evolution, commonly termed volatile content, observed when the carbon black is heated to 1742° F. in an inert atmosphere. It is preferred that the metal-impregnated carbonaceous particles are substantially composed of carbon black which has been sufficiently surface oxidized so as to be wetted by water. It is especially preferred that the metal-impregnated carbonaceous particles are substantially composed of carbon black which has been sufficiently surface oxidized so as to adsorb relatively greater quantities of catalytic metal salts from aqueous impregnating solutions, as compared the quantities which would be adsorbed by non-oxidized carbon black at corresponding conditions.

Surface oxidized carbon black is preferred because it is easier to handle than ordinary carbon black, and because experiments have shown that it results in a catalyst that is more selective. For the present purposes, more selective catalysts are defined as those which produce less toluene-insoluble coke at a given hydrocracking conversion. Further information regarding characterization and test methods for carbon black may be found in the *Kirk-Othmer Encyclope-*

*dia of Chemical Technology* (Fourth Edition) at pages 1055 to 1059 of Volume 4.

The particles have a suspended effective particle size of about 0.01 to about 50 microns, preferably about 0.01 to about 10 microns, more preferably about 0.01 to about 2 microns, with less than about 1 micron being ideal. For the present purposes, the Hegman Grind Gauge manufactured by Paul N. Gardner is the definitive measuring device for determining the effective particle size of slurries in the range of 0.1 to 25 microns. The Zeiss Inverted Microscope at 400×with a dark field condenser is designated the standard for slurries having larger particles and for slurries having smaller particles than can be accommodated by the Hegman Grind Gauge, down to the range where an electron microscope must be employed. Herein, the term effective particle size relates to the dimensions of solids as they are observed while suspended in a given medium. The effective particle size of the slurry may be greater than the initial size of the particles which were blended to produce the slurry. For example, if carbon particles are poorly dispersed in an oil, their effective particle size in a slurry may be greater than their initial particle size.

The particles physically support a sulfide of a water-soluble metal compound including a sulfidable metal selected from the group consisting of molybdenum, cobalt, nickel, iron, vanadium, tungsten, and mixtures thereof. Of these, molybdenum is especially preferred. The metal compound may be, for example, ammonium heptamolybdate, an alkali metal heptamolybdate, cobalt nitrate, nickel nitrate, ferrous sulfate, or sodium tungstate. Preferably, the total weight of the sulfidable metal supported on the impregnated particles in the reaction zone is about 1 to about 400 parts per million by weight, based on the sum of the weight of the feedstock and the weight of the lower boiling point product in the reaction zone.

The dispersion is a polyphasic mixture, such as a slurry, a suspension, a fluidized bed, or an ebullating bed, which includes at least a solid phase and a liquid phase, and preferably contains a gas as well. The gas phase, if present, may be introduced into the reaction zone, as in the case of added hydrogen, or may be produced in the reaction zone by a chemical or a physical reaction. Preferably, the total weight of the impregnated particles dispersed in the reaction zone is about 0.01 to about 5 weight percent, more preferably about 0.01 to about 1.0 percent, and most preferably about 0.1 to about 0.5 percent based on the sum of the weight of the feedstock and the weight of the lower boiling point product in the reaction zone. Practitioners will appreciate that the weight of the feedstock in the reaction zone tends to decrease as the feedstock is converted to the product.

The reaction zone is maintained at reaction conditions which are effective to convert the feedstock to a product having a boiling point of lower temperature, as compared to the boiling point of the feedstock. Preferably, the effective reaction zone conditions include a temperature of about 750 to about 900° F., more preferably about 780 to about 840° F. Preferably, the effective conditions include a hydrogen partial pressure of about 1000 to about 3500 pounds per square inch absolute, more preferably about 1500 to about 3000 pounds per square inch absolute.

In another preferred aspect, the invention is a method, substantially as described above but which additionally includes sulfiding carbonaceous catalyst precursor particles to produce the metal-impregnated carbonaceous particles, also described above. The sulfiding may be the result of exposing precursor particles to a sulfiding agent including, but not limited to, elemental sulfur, hydrogen sulfide, or a sulfur-containing hydrocarbon. The sulfiding may be accomplished in situ in the reaction zone, in which case the sulfiding agent may be introduced into the reaction zone or created in the reaction as the product of a chemical reaction. Alternatively, the sulfiding may be accomplished before the precursor particles enter the reaction zone. Conditions effective to sulfide the metal compound of the precursor particles are well-known.

In yet another preferred aspect, the invention is a method for preparing precursor particles. The method includes blending an impregnation solution with carbonaceous particles, as described above. The impregnation solution includes an oxygen-containing polar solvent, such as water or an ether or an alcohol. Water or ethanol are preferred solvents. The solvent also includes as a solute a water-soluble metal compound, as described above. Preferably, the impregnation solution contains an amount of the water-soluble metal compound which corresponds to about 100 to about 50,000 parts per million by weight of a sulfidable metal selected from the group consisting of molybdenum, cobalt, nickel, iron, vanadium, tungsten and mixtures thereof, based on the total weight of the carbonaceous particles. The method also includes vaporizing a substantial amount of the solvent from the blend to produce metal-impregnated catalyst precursor particles.

In still another preferred aspect, the invention is a method for preparing catalyst particles which comprises impregnating a water-soluble compound containing a sulfidable metal on carbonaceous particles by blending and vaporizing, substantially as described above, to produce catalyst precursor particles. The precursor particles are introduced to a liquid-phase hydrocarbon, comminuted to an effective particle size in the range of about 0.01 to about 50 microns, and sulfided to produce catalyst particles.

The following Examples are intended to better the communicate the invention. The Examples do not limit the scope of the invention or the appended claims in any way.

Catalyst Testing Procedure

Catalyst evaluation is conducted in a stirred, pressurizable constant-volume reactor utilizing the following performance testing procedure. Approximately 40 grams of a petroleum residuum is combined with enough catalyst to provide from 0 to 300 ppm by weight of molybdenum metal and from 0 to 1 weight percent of particulate solids in the reactor, as desired. Properties of the petroleum residuum are presented below in Table I.

The reactor is sealed, purged with hydrogen gas, and pressurized with hydrogen to a pressure of about 1300 about 1400 pounds per square inch gauge. The reactor is heated to a temperature of about 250 to about 400° F., and is held at this temperature while the catalyst is mixed into the feed for 15 minutes. Heating then continues to 825° F. over approximately 10 minutes. Reactor pressure peaks at a pressure of about 2000 to about 2600 pounds per square inch gauge and then decreases as hydrogen is consumed by a cracking reaction. Hydrogen additions are made as necessary to keep the pressure over 1900 pounds per inch while at hydrocracking temperatures. The reactor is held at 825° F. for 3 hours, during which time about 90% by weight or more of the feed having an atmospheric boiling point above 1000° F. is converted to products having an atmospheric boiling point below 1000° F. The reactor is cooled from 825° F. to a temperature below cracking temperatures within a period of about five minutes and, thereafter, is cooled to room temperature.

At room temperature, the contents of the reactor are washed with toluene to a 1 liter beaker, the volume in that beaker is brought up to approximately 400 milliliters with toluene, and the mixture is filtered through a dried and tarred extraction thimble. The thimble is extracted for 24 hours with fresh toluene, dried, and weighed. The weight of the thimble less the tare weight and the weight of the catalyst is taken to be the weight of toluene-insolubles (TI) formed during the reaction. The weight of toluene-insolubles (TI) is reported as a percentage of the resid feed weight.

TABLE I

| Feed Resid Properties | |
|---|---|
| asphaltene (heptane insolubles) | 27 wt. % |
| carbon | 83.1 wt. % |
| hydrogen | 9.7 wt. % |
| sulfur | 6.0 wt. % |
| nitrogen | 0.7 wt. % |
| oxygen | 0.5 wt. % |
| fraction boiling above 1000° F. | 85% |
| aromatic carbon | 32% |
| nickel | 110 ppm |
| vanadium | 540 ppm |
| iron | 20 ppm |
| Ramsbottom carbon | 24% |
| molecular weight (VPO) | 1000 |

Catalyst Preparation

EXAMPLE 1

In order to demonstrate the surprising effectiveness of the invention, a resid hydrocracking catalyst was prepared and performance tested, utilizing the Catalyst Testing Procedure described above. More specifically, the catalyst was prepared by dissolving 0.183 grams of ammonium heptamolybdate tetrahydrate in 12 grams of distilled water, adding 5.0 grams of partially oxidized carbon black particles having a particle size of 24 nanometers and a surface area of 138 square meters per gram to create an aqueous slurry, and thoroughly mixing the aqueous slurry to evenly wet the carbon particles. The water was evaporated by placing the aqueous slurry in a vacuum oven at approximately 25 inches of mercury vacuum and 75° C. for 24 hours, thereby impregnating the ammonium heptamolybdate on the carbon particles.

The impregnated carbon particles were added to 45 grams of a petroleum distillate fraction boiling between 360° F. and 700° F., which is known to petroleum refiners as light cycle oil, to produce a distillate slurry. This distillate slurry was then mixed on a relatively high-speed rotor/stator homogenizer for approximately 15 minutes at 12,000 rpm to comminute and disperse the impregnated carbon particles. Microscopic examination of the slurry thinned in immersion oil at 800×magnification using a dark field condenser showed the effective size of the particles to be less than 1 micron.

The Catalyst Testing Procedure was carried out as described above for a combination of 4.58 grams of the distillate slurry containing comminuted impregnated carbon particles with 40.30 grams of resid, the combination providing 200 ppm by weight of molybdenum and 1 weight percent of carbon particles in the resid. The weight of toluene-insolubles formed during the Catalyst Testing Procedure for this combination was calculated as 2.3 weight percent based on the weight of the resid feed.

EXAMPLES 2, 3, 4, and 5

Four additional catalysts of the invention were prepared and tested substantially as described in Example 1 above, except that various amounts of ammonium heptamolybdate tetrahydrate were combined to provide 100 ppm, 60 ppm, 40 ppm, and 20 ppm of molybdenum in the resid feed, respectively. The amount of carbon particles in the resid for each combination was controlled at 1 weight percent. Toluene-insolubles formation for the combinations were reported as 2.1, 2.4, 3.1, and 4.3 weight percent, respectively.

EXAMPLE 6

As a basis for comparison, a previously known oil-soluble catalyst system was prepared by blending 10 weight percent molybdenum naphthenate and a high-boiling, aromatic catalytic cracking product, known to petroleum refiners as decanted oil. 2.30 g of the oil-soluble catalyst system and 40.14 g of resid feed were combined to provide 300 ppm of molybdenum in resid with essentially no carbon particles. The combination was tested substantially as described above in the Catalyst Testing Procedure, and the toluene-insolubles yield was determined to be 2.2 weight percent based on the weight of the resid feed.

EXAMPLES 7, 8, 9, and 10

Additional combinations were prepared with varying amounts of the oil-soluble catalyst system to provide 145 ppm, 100 ppm, 75 ppm, and 50 ppm by weight of molybdenum in resid feed with essentially no carbon particles. These additional combinations were subjected to the Catalyst Testing Procedure and the resulting toluene-insoluble yields were calculated as 3.9, 5.9, 6.9, and 7.2 weight percent, respectively, based on the weight of the resid feed.

Results of Examples 1 through 10 are depicted graphically in FIG. 1. The impregnated catalyst of the present invention exhibited the selectivity function indicated in FIG. 1 by black squares, while the previously known oil-soluble catalyst exhibited the selectivity function indicated by white squares. For example, as shown in FIG. 1, toluene-insolubles production provided by the oil-soluble catalyst molynaphenate at a molybdenum concentration of 300 ppm is similar to the toluene-insolubles production provided by the impregnated catalyst of the present invention at 60 ppm of molybdenum supported on 1 weight percent of dispersed carbon black particles. In both cases, a toluene-insolubles production of about 2.4 weight percent is observed. Thus, the catalytic activity of molybdenum supported on carbon black is approximately 5 times higher for toluene-insolubles suppression as compared to molybdenum in the oil-soluble catalyst.

It is significant that both of the selectivity functions are similar in shape, and both appear to be asymptotic to a hydrocracking selectivity corresponding to about 1 weight percent of toluene-insolubles production under the above-described reaction conditions. These results indicate that, within limits, lesser amounts of toluene-insolubles are formed as the molybdenum concentration in the resid feed is increased for both the impregnated catalyst of the present invention and for the previously known oil-soluble catalyst. However, in the range of about 1 to about 400 ppm, preferably of about 1 to about 300 ppm, and more preferably of about 1 to about 200 ppm by weight of molybdenum concentration, while operating in the range of about 90 weight percent or greater hydrocracking yield, the impregnated catalyst of the present invention requires significantly less molybdenum concentration to provide a hydrocracking selectivity equal to that of the previously known oil-soluble catalyst.

EXAMPLE 11

A previously known catalyst, which is described in U.S. Pat. No. 4,863,887, was prepared by dissolving 0.0582 grams of ammonium heptamolybdate tetrahydrate in 7.5 grams of distilled water, and blending the resulting solution with 5.0 grams of partially oxidized carbon black particles and 45 grams of a light cycle oil to produce a slurry. Before blending, the carbon particles exhibited particle size of 24 nanometers and a surface area of 138 square meters per gram. The slurry was mixed at 12,000 rpm in a relatively high-speed rotor/stator homogenizer for 15 minutes. Unlike the catalyst of the present invention, molybdenum was not impregnated upon the carbon black particles.

The Catalyst Testing Procedure was carried out as described above for a combination of 4.36 grams of the slurry and 38.70 grams of the resid feed, providing 60 ppm by weight of unsupported molybdenum and 1 weight percent of unimpregnated carbon particles based on the weight of the resid feed. The weight of toluene-insolubles formed during the Catalyst Testing procedure was calculated as 3.7 weight percent based on the weight of the resid feed. A data point for this result is indicated in FIG. 1 by an x-shaped symbol.

The data in FIG. 1 demonstrates that the catalyst of the present invention is more selective at comparable conditions than either of the above-described previously known catalysts. By direct comparison in FIG. 1, it is apparent that the impregnated catalyst of the present invention containing 60 ppm by weight of impregnated molybdenum on 1 weight percent of carbon particles demonstrated a hydrocracking selectivity of 2.5 weight percent of toluene-insolubles, while the catalyst containing 60 ppm by weight of unimpregnated molybdenum and 1 weight percent carbon particles only achieved a hydrocracking activity corresponding to 3.7 weight per of toluene insolubles produced. By interpolation in FIG. 1, one may reasonably conclude that the impregnated catalyst of the present invention requires only about 20 ppm of molybdenum to provide the same selectivity, 3.7 weight percent of toluene-insolubles produced, that the catalyst containing unimpregnated molybdenum and carbon particles exhibited with the benefit of 60 ppm of unimpregnated molybdenum.

FIG. 1 is evidence that molybdenum supported on carbon black produces less toluene-insoluble coke, as compared to the amount of toluene-insoluble coke produced at essentially identical conditions in a reaction zone including hydrogen, the feedstock, and a dispersion created by suspending corresponding amounts of particles which are composed essentially of sulfided molybdenum naphthenate and carbon particles. Thus, the catalyst of the invention has a greater selectivity for suppressing coke, especially at low molybdenum concentrations, compared to physical mixtures of the same overall composition.

It is hypothesized that the surprising synergy provided by the impregnated catalyst of the present invention is due to more efficient use of molybdenum, as compared to that of previously known catalysts. It is believed that carbon particles tend to accumulate coke precursors, which may be suppressed or destroyed in the presence of catalytically active molybdenum. It is also believed that soluble catalysts tend to precipitate and agglomerate under resid hydrocracking conditions, thus reducing their availability. The inventors contemplate that impregnating catalytic molybdenum on suitable carbon particles tends to locate the molybdenum in regions where vulnerable coke precursors accumulate, as well as to discourage undue agglomeration of the molybdenum.

EXAMPLES 12, 13, and 14

Figure 2:
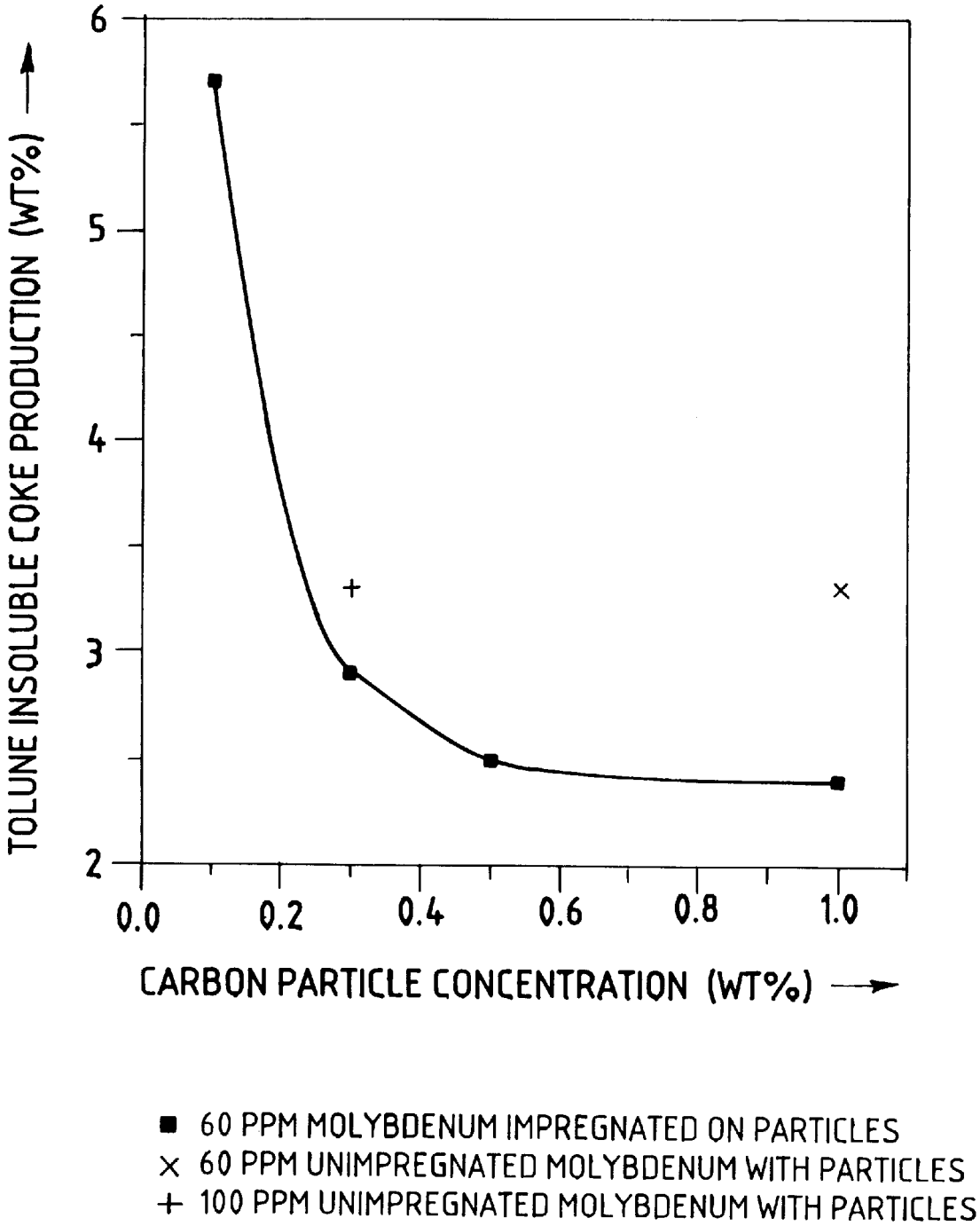
FIG. 2 is a graph which depicts toluene-insoluble coke production as a function of carbon particle concentration for catalysts of the invention and, also, for two comparable catalysts which lack impregnation.

A procedure was performed to demonstrate the effect of carbon particle concentration on the hydrocracking selectivity of molybdenum-impregnated carbon particles. In the procedure, three catalysts of the invention were prepared and tested substantially as described above in Example 1, except that the amount of ammonium heptamolybdate tetrahydrate combined was calculated to provide 60 ppm by weight of molybdenum in the resid feed for each test, while the amount of carbon black present was varied to provide combinations having 0.5, 0.3, and 0.1 weight percent of carbon particles, respectively. The yield of toluene-insolubles obtained as a result of the Catalyst Testing Procedure for each combination is depicted in FIG. 2, along with the yield previously described in Example 3 above. The data thus obtained for 60 ppm by weight of molybdenum impregnated on various concentrations of carbon black having an effective particle size of about one micron or less is indicated by black squares in FIG. 2.

For the sake of comparison, two data points obtained for impregnated molybdenum and carbon particle catalysts, of the type described in U.S. Pat. No. 4, 863,887, are also illustrated in FIG. 2. The data point for the first of the unimpregnated catalysts, indicated by an x-shaped symbol, is the yield of toluene insolubles described in Example 11 relating to the catalyst containing 60 ppm by weight of unimpregnated molybdenum and 1 weight percent carbon particles. The first of the data points provides a direct indication of the superiority of the present invention at 60 ppm molybdenum and 1.0 weight percent carbon.

The data point for the second of the unimpregnated catalysts relates to a catalyst which was prepared substantially in accordance with the method described in Example 11, but which was combined and tested in proportions that provided 100 ppm by weight of unimpregnated molybdenum and 0.3 weight percent of carbon particles based on the weight of resid feed. The second of the data points provides an indirect indication of the superiority of the present invention at 0.3 weight percent carbon, because the comparable data point for the present invention at 0.3 weight percent of carbon particles illustrates a greater toluene-insolubles selectivity even though it included significantly less molybdenum.

The data presented in FIG. 2 demonstrates that carbon particle concentration has a profound effect on the hydrocracking selectivity of the catalyst of the present invention, preferably in the range of about 0.01 to about 5.0 weight percent, more preferably in the range of about 0.01 to about 1.0 weight percent, and most preferably in the range of about 0.1 to about 0.5 weight percent carbon particles based on the weight of the resid feed.

EXAMPLE 15

In order to demonstrate the influence of effective particle size on the hydrocracking selectivity of molybdenum-impregnated carbon particles, the following procedure was performed. In the procedure, a catalyst of the invention was prepared and tested substantially as described above in Example 1, except that the amount of ammonium heptamolybdate tetrahydrate combined was adjusted to provide 33 ppm by weight of molybdenum in the resid feed; the amount of carbon black present was controlled to provide combinations having 0.3 weight percent of carbon; and particular attention was devoted to controlling and characterizing the effective particle size, as will now be described. For Example 15, the dried impregnated carbon particles were subsequently crushed with a mortar and pestle and passed through a nominal 100 Mesh sieve having 150 micron openings. A sample of the sieved carbon particles massing 1.0 gram was stirred into 9.0 grams of decanted oil to form a slurry.

The slurry was examined using a Hegman Grind Gauge manufactured by Paul N. Gardner, Inc. The gauge is set to measure slurries having particle sizes from 0 to 25 micron on the gauge. This slurry measured greater than 25 micron on the gauge. The slurry was also examined on a Zeiss Inverted Microscope at 400×magnification with a dark field condenser. The microscopic examination indicated that the effective particle size of the slurry ranged from sub-micron to 150 microns, with the bulk of the carbon present as particles having an effective size in the range of about 75 to 125 microns. For the present purposes, this slurry is considered to have an effective size of 100 microns.

Figure 3:
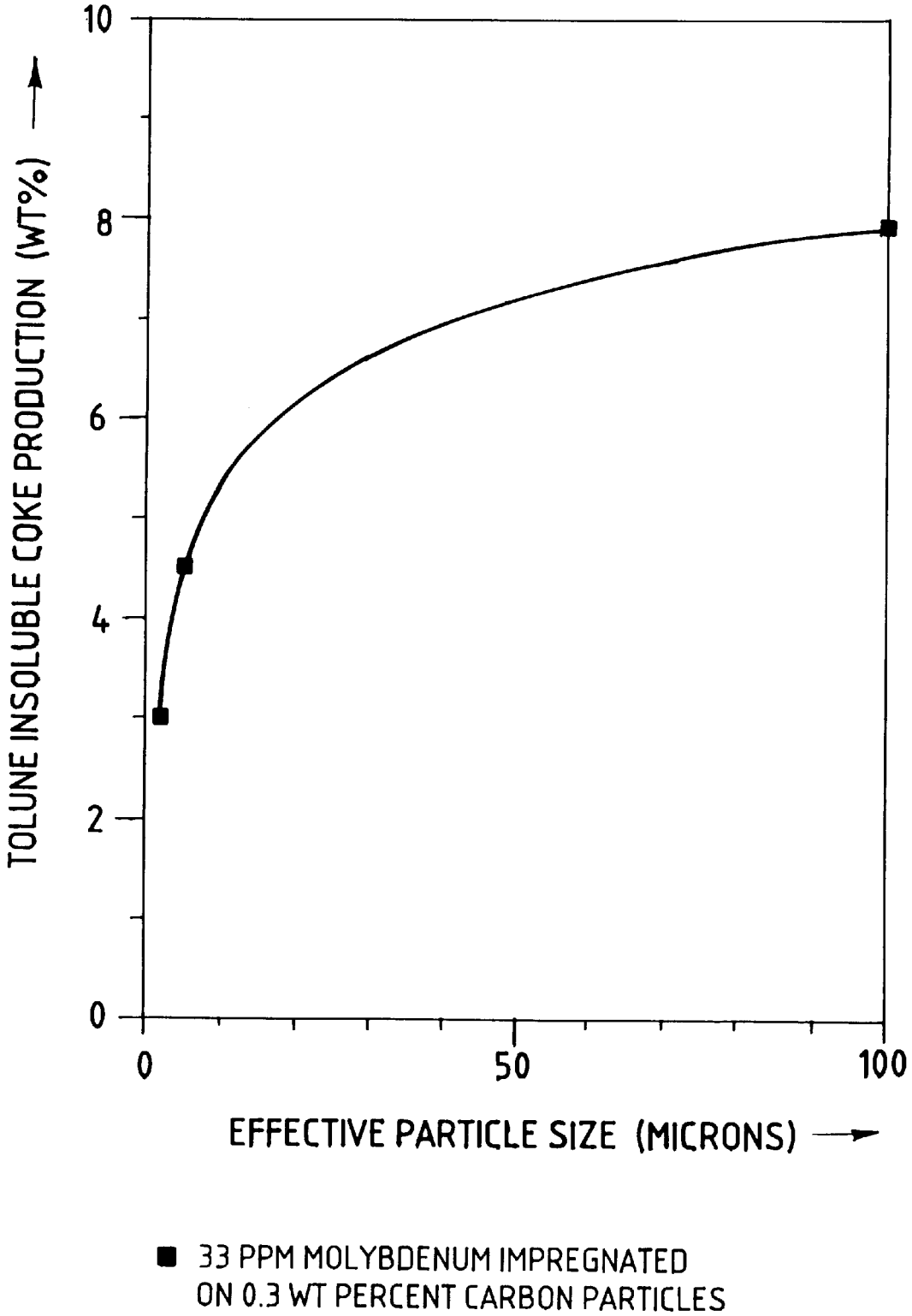
FIG. 3 is a graph which depicts toluene-insoluble coke production as a function of effective particle size for catalysts of the invention.

The Catalyst Testing Procedure described above was performed with a combination consisting essentially of 1.34 grams of the slurry and 42.02 grams of the resid feed, providing 33 ppm of impregnated molybdenum and 0.3 weight percent of carbon particles. The test yielded 7.9 weight percent of carbon insolubles. The yield of toluene insolubles obtained as a result of the Catalyst Testing Procedure for Example 15 is depicted in FIG. 3.

EXAMPLE 16

The procedure described in Example 15 above was substantially repeated except that the dried molybdenum-impregnated carbon particles were ground with three-eighths inch stainless steel balls in decanted oil for ten minutes at 300 rpm using a 1S Attritor, also known as a shot mill, which was commercially obtained from Union Process. The grinding produced a slurry which was examined using a Hegman Gauge, as described above. The Hegman Grind Gauge indicated that the carbon particles in the slurry had an effective size of 5 microns, with many particles measuring up to 15 micron in size. Examination on a Zeiss Inverted Microscope at 640×magnification with a dark field condenser indicated that individual particles of less than one micron had apparently agglomerated to produce the larger particles which effectively constituted the slurry. For the present purposes, this slurry is considered to have an effective size of 5 microns.

The Catalyst Testing Procedure was performed with a combination of the slurry and resid feed having 33 ppm of impregnated molybdenum and 0.3 weight percent of carbon particles. The test produced 4.6 weight percent of toluene-insolubles, as illustrated in FIG. 3.

EXAMPLE 17

The procedure described in Example 15 above was substantially repeated except that the dried impregnated carbon particles were ground for four hours. The effective particle size of the slurry was determined to be 2 microns by the use of a Hegman Grid Gauge.

The Catalyst Testing Procedure was performed with a combination of the slurry and resid feed having 33 ppm of impregnated molybdenum and 0.3 weight percent of carbon particles. The test produced 3.0 weight percent of toluene-insolubles, as illustrated in FIG. 3.

Turning now to FIG. 3, the influence of effective particle size on the catalyst of the present invention can be seen to be dramatic in the range of about 0.01 to 100 microns. The catalyst is, evidently, relatively ineffective for larger, effective carbon particle sizes. The data in FIG. 3 indicates that carbon particles having effective sizes in the range of about 0.01 to about 50 microns are preferable for their superior selectivity, with carbon particles in the range of about 0.01 to about 10 microns being more preferable, and about 0.01 to about 2 microns being most preferable.

EXAMPLE 18

A procedure was carried out which demonstrates advantages of employing oxidized carbon black in the present invention. The procedure was substantially similar to the procedure described above in Example 15, except that various types of commercially available oxidized and non-oxidized carbon blacks were employed as carbon particles, and that the amounts of ammonium heptamolybdate tetrahydrate and carbon black were adjusted to provide 50 ppm by weight of molybdenum in the resid feed and 0.3 weight percent of carbon, respectively. The results of the Catalyst Testing Procedure for the various types of oxidized and non-oxidized carbon black are presented below in Table II.

TABLE II

Performance of Various Carbon Blacks

| Carbon Black | Initial Particle Size (nanometers) | Oxidized | Toluene Insolubles (wt. percent) | Surface Area ($m^2$/gram) | Volatiles Content (wt. percent) |
|---|---|---|---|---|---|
| A | 15 | No | 3.0 | 230 | 2.0 |
| B | 24 | Yes | 3.0 | 138 | 5.0 |
| C | 25 | Yes | 3.1 | 96 | 3.5 |
| D | 24 | No | 5.7 | 112 | 1.0 |
| E | 25 | No | 6.3 | 84 | 1.0 |
| F | 75 | No | 8.9 | 25 | 0.5 |

Inspection of Table II reveals that non-oxidized carbon blacks D and E, which are comparable in size and surface area to oxidized carbon blacks B and C, produced about twice as much objectionable toluene-insoluble coke as did oxidized carbon blacks B and C. Therefore, Table II contains evidence that oxidized carbon blacks employed in the present invention are relatively more selective for reducing toluene-insoluble coke production than are comparable non-oxidized carbon blacks.

Additionally, the data in Table II indicates that oxidized carbon blacks B and C performed about as well as non-oxidized carbon black A. This result is surprising because non-oxidized carbon black A exhibited significantly smaller initial particle size and larger surface area, as compared to those of oxidized carbon blacks B and C.

It is hypothesized that the advantage in selectivity provided by oxidized carbon black is at least partially due to enhanced adsorption of water-soluble, catalytic metal salts onto the surface of the oxidized carbon black during preparation of the catalyst particles. It is well-known that the surface of carbon black is modified during the oxidation process by, for example, the addition of hydroxyl groups. The inventors believe that the surface modification brought about by oxidation of the carbon black facilitates the supporting of catalytic metal oxides on the carbon black. It may be that the impregnating solution more easily wets oxidized carbon black and, therefore, metals are adsorbed onto the oxidized carbon black in greater quantities or in more accessible locations.

One objective indication of such desirable surface modification is that the oxidized carbon black is easily wetted by water during catalyst preparation and additionally adsorbs larger quantities of catalytic metal, such as ammonium heptamolybdate. For the present purposes, "wetted" pertains to material that has accepted liquid either on its surface or within its pore structure. Accordingly, it is preferred that the carbon black employed in the present invention be sufficiently oxidized so as to be wetted by water. It is especially preferred that the carbon black be sufficiently oxidized so as to be wetted so as to adsorb relatively greater quantities of catalytic metal salts, as compared the quantities which would be adsorbed by non-oxidized carbon black at corresponding conditions.

Although Examples and hypotheses have been set forth above in order to better communicate the invention, they are not intended to limit the scope of the invention or the appended claims.

We claim as our invention:

1. A method for converting a hydrocarbonaceous feedstock to a product having a boiling point of lower temperature, as compared to the boiling point of the feedstock, which comprises:

suspending metal-impregnated carbonaceous particles which are composed essentially of impregnated metals on carbon black sufficiently oxidized so as to be wetted by contact with water, which have an effective suspended particle size of about 0.01 to about 50 microns, and which physically support a sulfide of a water-soluble metal compound including a sulfidable metal selected from the group consisting of molybdenum, cobalt, nickel, iron, vanadium, tungsten and mixtures thereof, in a reaction zone which includes hydrogen and a hydrocarbonaceous feedstock so as to create a dispersion;

maintaining conditions in the reaction zone which are effective to convert the feedstock to a product having a boiling point of lower temperature, as compared to the boiling point of the feedstock; and recovering the lower boiling point product.

2. The method of claim 1 wherein a toluene-insoluble coke is also produced in the reaction zone, and wherein the amount of toluene-insoluble coke produced is relatively less than, as compared to the amount of toluene-insoluble coke produced at identical conditions in a reaction zone including hydrogen, the feedstock and a dispersion created by suspending corresponding amounts of particles which are composed essentially of the sulfided metal compound and particles which are composed essentially of carbon.

3. The method of claim 1 wherein the total weight of the impregnated particles dispersed in the reaction zone is about 0.01 to about 5 weight percent, based on the sum of weight of the feedstock and the weight of the lower boiling point product in the reaction zone.

4. The method of claim 1 wherein the total weight of the sulfidable metal supported on the impregnated particles in the reaction zone is about 1 to about 400 parts per million by weight, based on the sum of the weight of the feedstock and the weight of the lower boiling point product in the reaction zone.

5. The method of claim 1 wherein the sulfidable metal is molybdenum.

6. The method of claim 1 wherein the metal impregnated carbonaceous particles are composed essentially of impregnated metals on carbon black which has been sufficiently oxidized so as to be wetted by contact with water; and the metal-impregnated carbonaceous particles are sufficiently surface oxidized to be wetted by water.

7. The method of claim 1 wherein the feedstock includes a hydrocarbon material having a boiling point equal to or greater than 1000° F.

8. The method of claim 1 wherein the effective reaction zone conditions include a temperature of about 750 to about 900° F. and a hydrogen partial pressure of about 1000 to about 3500 pounds per square inch absolute.

9. A method for converting a hydrocarbonaceous feedstock to a product having a boiling point of lower temperature, as compared to the boiling point of the feedstock, which comprises:

sulfiding carbonaceous precursor particles which are composed essentially of impregnated metals on carbon black sufficiently oxidized so as to be wetted by contact with water, and which include a water-soluble metal compound containing a sulfidable metal selected from the group consisting of molybdenum, cobalt, nickel, iron, vanadium, tungsten and mixtures thereof, to produce catalyst particles substantially composed of carbon and a sulfide of the water-soluble metal compound;

suspending the catalyst particles in a reaction zone which includes hydrogen and a hydrocarbonaceous feedstock so as to create a dispersion of the catalyst particles;

maintaining conditions in the reaction zone which are effective to convert the feedstock to a product having a lower temperature boiling point, as compared to the boiling point of the feedstock; and recovering the lower boiling point product.

10. The method of claim 9 wherein a toluene-insoluble coke is also produced in the reaction zone, and wherein the amount of toluene-insoluble coke produced is relatively less than, as compared to the amount of toluene-insoluble coke produced at identical conditions in a reaction zone including hydrogen, the feedstock and a dispersion created by suspending corresponding amounts of particles which are composed essentially of the sulfided metal compound and particles which are composed essentially of carbon.

11. The method of claim 9 wherein the total weight of the catalyst particles dispersed in the reaction zone is about 0.01 to about 5 weight percent, based on the sum of weight of the feedstock and the weight of the lower boiling point product in the reaction zone.

12. The method of claim 9 wherein the total weight of the sulfidable metal supported on the catalyst particles in the reaction zone is about 1 to about 400 parts per million by weight, based on the sum of the weight of the feedstock and the weight of the lower boiling point product in the reaction zone.

13. The method of claim 9 wherein the sulfidable metal is molybdenum.

14. The method of claim 9 wherein the feedstock includes a hydrocarbon material having a boiling point equal to or greater than 1000° F.

15. A method for converting a hydrocarbonaceous feedstock to a product having a boiling point of lower temperature, as compared to the boiling point of the feedstock, which comprises:

sulfiding carbonaceous precursor particles which are composed essentially of impregnated metals on carbon black sufficiently oxidized so as to be wetted by contact with water, which have an effective suspended particle size of about 0.01 to about 50 microns, and which include a water-soluble metal compound containing a sulfidable metal selected from the group consisting of molybdenum, cobalt, nickel, iron, vanadium, tungsten and mixtures thereof, to produce catalyst particles substantially composed of carbon and a sulfide of the water-soluble metal compound;

suspending the catalyst particles in a reaction zone which includes hydrogen and a hydrocarbonaceous feedstock so as to create a dispersion;

maintaining conditions in the reaction zone which are effective to convert the feedstock to a product having a boiling point of lower temperature, as compared to the boiling point of the feedstock; and recovering the lower boiling point product.

16. The method of claim 15 in which the carbon black contains about 2 to about 6 weight percent oxygen.

17. The method of claim 15 in which the carbon black exhibits a weight loss of about 2 to about 9.5 percent when the carbon black is heated to 1742 degrees F. in an inert atmosphere.

* * * * *

UNITED STATES PATENT AND TRADEMARK OFFICE

CERTIFICATE OF CORRECTION

PATENT NO. : 5,951,849

DATED : Sep. 14, 1999

INVENTOR(S) : Jeffrey T. Miller, Ronald B. Fisher, Tracy L. Marshbanks

It is certified that error appears in the above-identified patent and that said Letters Patent is hereby corrected as shown below:

| Col. | Line | |
|---|---|---|
| 13 | 2 | "as compared the"<br><br>should read:<br>"as compared with the" |
| 4 | 57 | "as compared the quantities"<br><br>should read:<br>"as compared with the quantities" |
| 6 | 35,36 | "to better the communicate"<br><br>should read:<br>"to better communicate" |
| 6 | 48 | "about 1300 about"<br><br>should read:<br>"about 1300 to about" |

UNITED STATES PATENT AND TRADEMARK OFFICE

CERTIFICATE OF CORRECTION

PATENT NO. : 5,951,849

DATED : Sep. 14, 1999

INVENTOR(S) : Jeffrey T. Miller, Ronald B. Fisher, Tracy L. Marshbanks

It is certified that error appears in the above-identified patent and that said Letters Patent is hereby corrected as shown below:

| Col. | Line | |
|---|---|---|
| 11 | 33 | "15 micron in size." |
| | | should read: "15 microns in size." |

Signed and Sealed this

Fourth Day of July, 2000

*Attest:*

Q. TODD DICKINSON

*Attesting Officer*

*Director of Patents and Trademarks*